US009058919B2

(12) United States Patent
Takayama et al.

(10) Patent No.: US 9,058,919 B2
(45) Date of Patent: Jun. 16, 2015

(54) WATER PROOF PRESS CONTACT TERMINAL AND METHOD FOR FORMING WATER PROOF PRESS CONTACT TERMINAL

(71) Applicant: YAZAKI CORPORATION, Tokyo (JP)

(72) Inventors: Tsutomu Takayama, Shizuoka (JP); Takahito Nakashima, Aichi (JP); Hiroshi Kobayashi, Aichi (JP); Saori Muramatsu, Aichi (JP)

(73) Assignee: YAZAKI CORPORATION, Tokyo (JP)

( * ) Notice: Subject to any disclaimer, the term of this patent is extended or adjusted under 35 U.S.C. 154(b) by 61 days.

(21) Appl. No.: 13/862,039

(22) Filed: Apr. 12, 2013

(65) Prior Publication Data

US 2013/0220698 A1 Aug. 29, 2013

Related U.S. Application Data

(63) Continuation of application No. PCT/JP2011/074231, filed on Oct. 14, 2011.

(30) Foreign Application Priority Data

Oct. 14, 2010 (JP) ..... 2010-231393

(51) Int. Cl.
*H01B 7/282* (2006.01)
*H01R 43/16* (2006.01)
(Continued)

(52) U.S. Cl.
CPC ..... *H01B 7/282* (2013.01); *Y10T 29/49218* (2015.01); *H01R 4/20* (2013.01);
(Continued)

(58) Field of Classification Search
CPC .... H01B 7/282; H01R 43/16; H01R 43/0482; H01R 4/20; H01R 4/4872; H01R 9/0518; H01R 13/10; H01R 13/5205; Y10T 29/49218
USPC ..... 174/84 C, 84 R, 94 R; 439/877, 878, 882, 439/775, 585
See application file for complete search history.

(56) References Cited

U.S. PATENT DOCUMENTS 3,670,293 A 6/1972 Garver
3,699,504 A 10/1972 Huber
(Continued)

FOREIGN PATENT DOCUMENTS

CN 1619885 A 5/2005
DE 100 04 813 A1 8/2000
(Continued)

OTHER PUBLICATIONS

International Search Report and Written Opinion of the International Search Report for PCT/JP2011/074231 dated Dec. 29, 2011.
(Continued)

*Primary Examiner* — Hoa C Nguyen
*Assistant Examiner* — Amol Patel
(74) *Attorney, Agent, or Firm* — Kenealy Vaidya LLP

(57) ABSTRACT

A water proof press contact terminal includes a base portion, a pair of first press contact pieces, a pair of second press contact pieces, and a covering member. The first press contact pieces are provided at both sides of a front part of the base portion. The second press contact pieces are provided at both sides of a rear part of the base portion, press contact a sheath of a wire. The covering member is provided on the base portion. A core wire of the wire is inserted into the covering member so as to be covered in a waterproof manner, and is press contacted by the first press contact pieces together with the covering member.

8 Claims, 3 Drawing Sheets

(51) Int. Cl.

| | |
|---|---|
| ***H01R 4/20*** | (2006.01) |
| ***H01R 4/48*** | (2006.01) |
| ***H01R 43/048*** | (2006.01) |
| *H01R 9/05* | (2006.01) |
| *H01R 13/10* | (2006.01) |
| *H01R 13/52* | (2006.01) |

(52) U.S. Cl.
CPC ..... *H01R 4/4872* (2013.01); *H01R 9/0518* (2013.01); *H01R 13/10* (2013.01); *H01R 13/5205* (2013.01); *H01R 43/0482* (2013.01); *H01R 43/16* (2013.01)

(56) References Cited

U.S. PATENT DOCUMENTS

| | | | | |
|---|---|---|---|---|
| 4,951,389 | A * | 8/1990 | Kaley et al. | 29/863 |
| 5,342,996 | A * | 8/1994 | Ito | 174/84 C |
| 6,142,816 | A * | 11/2000 | Kameyama | 439/394 |
| 7,252,564 | B1 * | 8/2007 | Morello et al. | 439/877 |
| 7,422,480 | B1 * | 9/2008 | Musick et al. | 439/585 |
| 2004/0203286 | A1 | 10/2004 | Kameyama | |
| 2010/0035482 | A1 | 2/2010 | Nakamura et al. | |

FOREIGN PATENT DOCUMENTS

| | | | |
|---|---|---|---|
| JP | S55-105270 | U | 7/1980 |
| JP | 5-45903 | U | 6/1993 |
| JP | 5-90855 | U | 12/1993 |
| JP | 2000-228266 | A | 8/2000 |
| JP | 2004-207172 | A | 7/2004 |
| JP | 2010-055874 | A | 3/2010 |

OTHER PUBLICATIONS

Chinese Office Action for the related Chinese Patent Application No. 201180049784.1 dated Dec. 2, 2014.
Korean Office Action for the related Korean Patent Application No. 10-2013-7009395 dated Feb. 27, 2015.
Korean Office Action for the related Korean Patent Application No. 10-2013-7009395 dated Aug. 27, 2014.
Japanese Office Action for the related Japanese Patent Application No. 2010-231393 dated Aug. 25, 2014.

* cited by examiner

WATER PROOF PRESS CONTACT TERMINAL AND METHOD FOR FORMING WATER PROOF PRESS CONTACT TERMINAL

BACKGROUND

The present invention is related to a water proof press contact terminal and a method for forming a water proof press contact terminal for preventing rust of a core wire part of an electric wire which is press contacted to an electric wire press contact part of a terminal.

Conventionally, to press contact an exposed core wire part made of electrically conductive metal and a sheath part made of a synthetic resin of an insulating coated electric wire to a terminal made of electrically conductive metal, for instance, Patent Document 1 discloses that a core wire press contact part of a terminal is extended to a rear sheath in order to prevent water droplets from sticking to an exposed core wire part. A roof shaped covering part is integrally extended and formed in a front end of the core wire press contact part to cover an end of the exposed core wire part with the covering part and protect the core wire part.

Further, Patent Document 2 discloses that a U shaped folded part is integrally formed in a front base plate part of a core wire press contact part as a press contact terminal for an intermediate joint, but to improve a positioning property of an end of an exposed core wire part of an electric wire. The exposed core wire part is arranged inside the folded part, an exposed core wire part of other electric wire is arranged outside the folded part. The core wire press contact part is press contacted to the folded part to join both the electric wires together. However, the U shaped folded part in Patent Document 2 is formed in order not to waterproof.

FIG. 7 shows one form of a terminal with an electric wire as a reference in which an electric wire 53 is attached under pressure and connected to a usual press contact terminal 52. Reference numeral 54 designates a core wire press contact part. Reference numeral 55 designates a sheath press contact part. Reference numeral 56 designates a female type electric contact part to which a mate male terminal is inserted and connected.

A press contact operation of the terminal 52 and the electric wire 53 is carried out between an anvil (a lower mold) and a crimper (an upper mold) of a terminal press contact machine which is not shown in the drawing. Since after the press contact operation, a core wire 51 is exposed short in front and rear parts of the core wire press contact part 54, core wire exposed parts 51*a* and 51*b* need to be waterproofed. Especially, when a copper alloy is used for the press contact terminal 52 and aluminum is used for the core wire 51 of the electric wire 53 and water sticks to the terminal 52 and the core wire 51 made of dissimilar metals, a corrosion is liable to progress by an electrochemical reaction to increase an electric resistance due to the corrosion and deteriorate a current supply performance.

FIG. 8 shows one example of a stamped form of a transverse chain terminal 57 as a base material of the usual press contact terminal 52 as a reference. A base plate part 60 is arranged in one side end of a chain belt 58 through a connecting piece 59, one pair of sheath contact pressure pieces 55 protrude to both sides from a rear end of the base plate part 60 and one pair of core wire press contact pieces 54 protrude to both sides from an intermediate part of the base plate part 60. In a front part of the base plate part 60, the male or female type electric contact part 56 is arranged.

The press contact pieces 54 and 55 or the electric contact part 56 are respectively formed by a bending work by a press from the expanded states shown in FIG. 8 and the press contact pieces 54 and 55 are respectively raised upward. Press contact parts are formed respectively by the pairs of press contact pieces 54 and 55 and the base plate part 60 between them. In the chain belt 58, hole parts 61 are provided with which terminal feeding pawls of the terminal press contact machine not shown in the drawing are engaged. The chain belt 58 is cut from the connecting piece 59 and separated from the terminal 52 at the same time as the press contact of the electric wire 53 in the terminal press contact machine.

[Patent Document 1] JP-A-2010-55874

[Patent Document 2] JP-UM-A-5-45903

SUMMARY

In the conventional press contact terminal disclosed in the above-described Patent Document 1, water may possibly enter from a gap between an end of the covering part bent downward and a base plate part of the terminal and stick to the exposed core wire part in the front end side of the core wire press contact part.

Further, in the conventional press contact terminal disclosed in the Patent Document 2, since water enters the end part of the exposed core wire part of the electric wire from gaps at both sides in the direction of width between the folded parts and the base plate part, a water proof effect cannot be anticipated.

It is therefore one advantageous aspect of the present invention to provide a water proof press contact terminal and a method for forming a water proof press contact terminal that can improve a water proof property of a core wire exposed part of an electric wire in a core wire press contact part of the terminal.

According to one advantage of the invention, there is provided a water proof press contact terminal, comprising:

a base portion;

a pair of first press contact pieces, provided at both sides of a front part of the base portion;

a pair of second press contact pieces, provided at both sides of a rear part of the base portion, and configured to press contact a sheath of a wire; and a covering member provided on the base portion, wherein a core wire of the wire is inserted into the covering member so as to be covered in a waterproof manner, and is press contacted by the first press contact pieces together with the covering member.

The water proof press contact terminal may be configured such that: the covering member includes a bottom part extending along the base portion and a folded part folded from a front end of the bottom part and extending rearward, and the core wire is inserted into a gap between the bottom part and the folded part, and the folded part is press contacted by the first press contact pieces together with the core wire.

At least a front end part of the gap may be covered with the pair of the first press contact pieces in a state where the core wire is press contacted thereby.

At least a front end part of the gap may be covered with a pair of side walls extended forward from the first press contact pieces respectively in a state where the core wire is press contacted thereby.

The folded portion may extend from the front end of the bottom part to the sheath so as to cover a part of the sheath.

The folded portion may be press contacted by the second press contact pieces.

The water proof press contact terminal may be configured such that: the covering member includes a tubular portion extending along the base portion and a seal portion sealing a front opening of the tubular portion, and the core wire is inserted into inside of the tubular portion, and the tubular portion is press contacted by the first press contact pieces together with the core wire.

The core wire and a part of the sheath of the wire may be inserted into the tubular portion.

The tubular portion may be press contacted by the second press contact pieces.

According to one advantage of the invention, there is provided a method for forming the water proof press contact terminal, the method comprising:

preparing a chain terminal, being expanded, and including:

a chain belt;

a first connecting portion extended from one side of the chain belt;

the base portion connected to the first connecting portion;

the first press contact pieces and the second press contact pieces;

a second connecting portion extended from the other side of the chain belt; and a covering plate connected to the second connecting portion, folding the covering plate together with the second connecting portion so that the covering plate is disposed on the base portion; and bending the covering plate to form the covering member, after the folding of the covering plate.

DETAILED DESCRIPTION OF EXEMPLIFIED EMBODIMENTS

Figure 1:
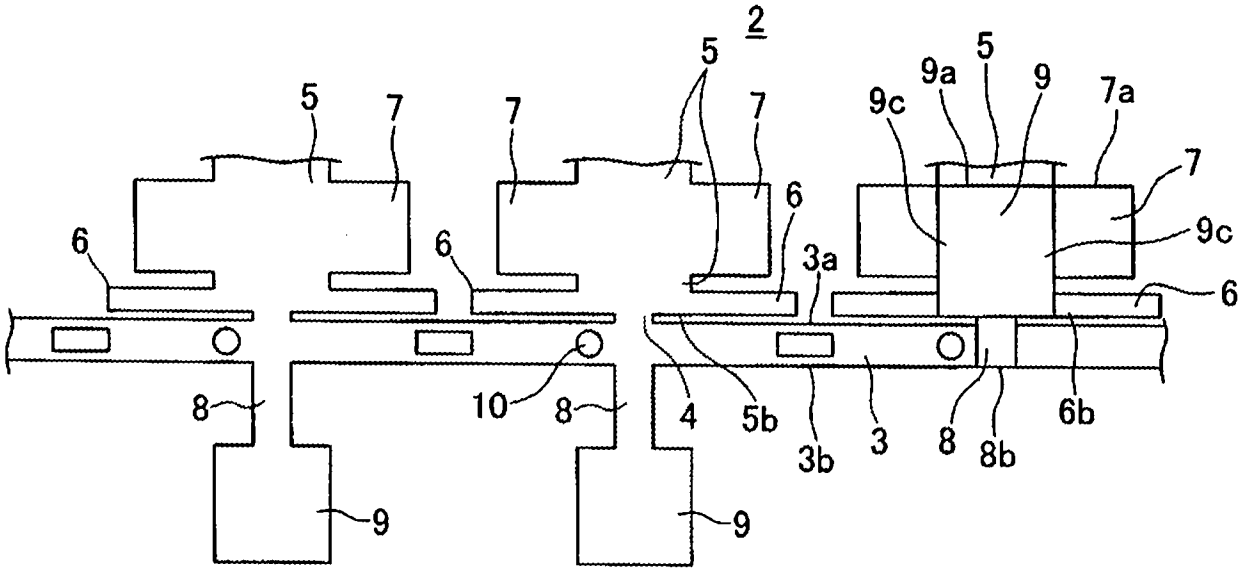
FIG. 1 is a plan view showing an expanded state of one exemplary embodiment of a chain terminal in a water proof press contact terminal and a method for forming the water proof press contact terminal according to the present invention.

FIGS. 1 to 5 show a water proof press contact terminal and a method for forming the water proof press contact terminal according to the present invention. FIG. 1 shows an expanded state of a plate shaped transverse chain terminal 2 (a chain terminal) made of electrically conductive metal for obtaining a water proof press contact terminal 1.

The chain terminal 2 includes a transversely long chain belt (a chain belt) 3, a horizontal base plate (a base portion) 5 integrally continuous to one side end (a front end) 3*a* of the chain belt 3 through a first short and narrow connecting piece (a first connecting portion) 4 in a direction orthogonal to the chain belt 3, one pair of sheath press contact pieces (second press contact pieces) 6 protruding orthogonally to a rear end 5*b* of the base plate 5 and in parallel with the chain belt 3, one pair of core wire press contact pieces (first press contact pieces) 7 adjacent to a front part of the sheath press contact pieces 6 and protruding orthogonally to the base plate 5 and in parallel with the chain belt 3, an electric contact part which is integrally continuous to a front part of the base plate 5 and is not shown in the drawing, a second connecting piece 8 which is long than the first connecting piece 4 and protrudes coaxially with the connecting piece 4 and the base plate 5 in a direction opposite by 180° to the connecting piece 4 and the base plate 5 from the other side end (a rear end) 3*b* of the chain belt 3 and a waterproofing electric wire covering plate 9 integrally continuous to a rear end of the second connecting piece 8.

A plurality of first connecting pieces 4 are arranged in parallel at equal pitches in the longitudinal direction of the chain belt 3 together with the base plate 5. A plurality of second connecting pieces 8 are arranged in parallel at equal pitches with the same width as that of the first connecting piece 4 and the length several times to ten times as long as the first connecting piece 4 on extending lines of the first connecting pieces 4 in the longitudinal direction of the chain belt 3. The first connecting piece 4 is located substantially at a central part in the direction of width of the base plate 5.

The electric wire covering plate (a covering plate) 9 is formed in a rectangular shape in the longitudinal direction of the second connecting piece 8. Each connecting piece 8 is located in a central part in the direction of width of the covering plate 9. The width (a length in a transverse direction) of the covering plate 9 in this exemplary embodiment is substantially the same as that of the base plate 5.

An illustration in the right side of FIG. 1 shows a state that the covering plate 9 is folded on the base plate 5 from a base end (a root part) 8*b* of the second connecting piece 8.

The length of the covering plate 9 in this exemplary embodiment is substantially equal to, as shown in a right side in FIG. 1, a length from a rear end 6*b* of the sheath press contact piece 6 to a front end 7*a* of the core wire press contact piece 7, that is, the total of a width of the sheath press contact piece 6 and a width of the core wire press contact piece 7 and a length of the base plate 5 between the sheath press contact piece 6 and the core wire press contact piece 7. Further, the length of the second connecting piece 8 is substantially equal to a length from the rear end 3*b* of the chain belt 3 and the rear end 6*b* of the sheath press contact piece 6, that is, the total of a width of the chain belt 3 and a length of the first connecting piece 4.

In the chain belt 3, hole parts 10 which are engaged with feeding pawls of a terminal press contact machine not shown in the drawing are provided at equal pitches. The chain belt 3 is cut and removed together with the first and second connecting pieces 4 and 8 by a cutting edge (not shown in the drawing) at the same time as the press contact of an electric wire 11 in the terminal press contact machine.

Figure 2:
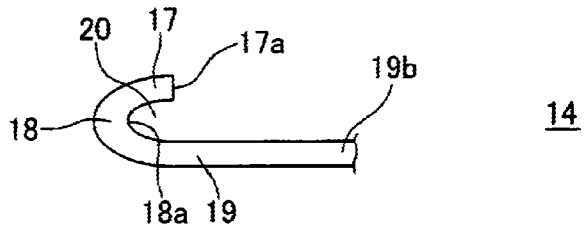
FIG. 2 is a side view showing a first electric wire covering member formed from a covering plate of the chain terminal.
Figure 3:
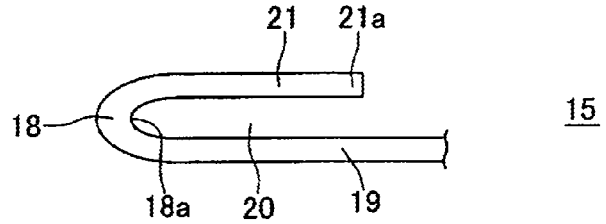
FIG. 3 is a side view showing a second electric wire covering member formed from the covering plate of the chain terminal.
Figure 4:
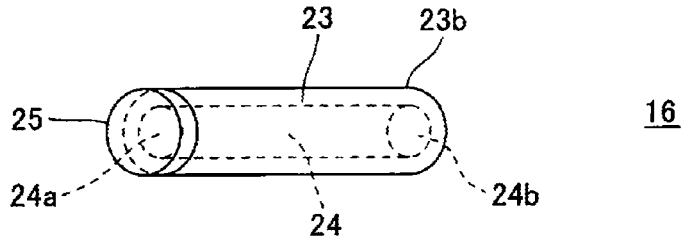
FIG. 4 is a perspective view showing a third electric wire covering member formed from the covering plate of the chain terminal.

The folded covering plate 9 shown in the right side of FIG. 1 is formed to electric wire covering members 14 to 16 of forms respectively shown in FIG. 2 to FIG. 4. The covering plates 9 are folded and formed sequentially from the right side of the chain terminal 2 in FIG. 1 or together at the same time.

In the terminal press contact machine, the electric wire (a wire) 11 traverses the chain belt 3, a core wire 13 with a sheath 12 of an end side peeled is arranged between the pair of core wire press contact pieces 7 and a rear sheath 12 of the core wire 13 is arranged between the pair of sheath press contact pieces 6.

The pair of core wire press contact pieces 7 and the base plate 5 between them form a core wire press contact part. The pair of sheath press contact pieces 6 and the base plate 5 between them form a sheath press contact part. The core wire press contact part and the sheath press contact part form an electric wire press contact part.

Figure 5:
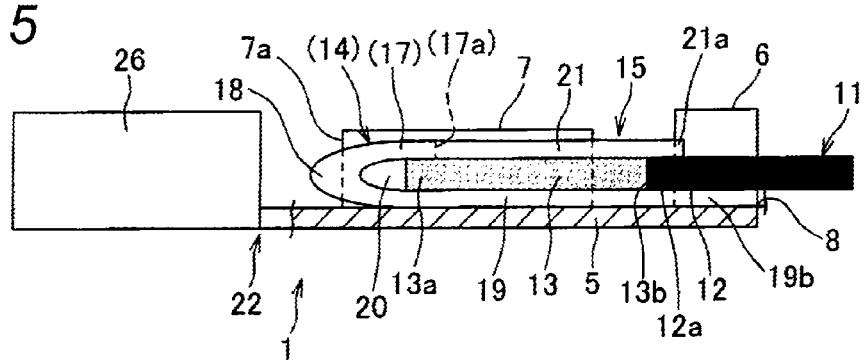
FIG. 5 is a partly sectional side view showing one exemplary embodiment of the water proof press contact terminal according to the present invention.

In the electric wire covering member 14 of an example shown in FIG. 2, an end part (a front end part) 9*a* of the folded covering plate 9 shown in the right side of FIG. 1 is folded rearward and short in the shape of U so as to cover an end side part 13*a* of the core wire 13 of the electric wire 11 in FIG. 5 with a short plate shaped folded portion 17. The covering plate 9 shown in the right side of FIG. 1 may be extended forward to be longer than the illustration of FIG. 1. In FIG. 5, an end (a rear end) of the folded portion 17 is shown by a chain line. The end side part 13*a* of the core wire 13 corresponds to the exposed part 51*a* of a front side of the core wire of the usual example shown in FIG. 7.

The folded portion 17 shown in FIG. 2 is continuous rearward from a curved bent part 18 of a front end. The bent part 18 has a curved inner surface 18*a* and an outer surface. The folded portion 17 prevents an entry of water from an upper part relative to the core wire 13 and the bent part 18 prevents the entry of water from a front part.

Under a state that the end part 13*a* of the core wire 13 of the electric wire 11 is inserted and set into the folded portion 17 shown in FIG. 2 from a rear part, as shown in FIG. 5. The pair of core wire press contact pieces 7 are press contacted inward from both sides of the folded portion 17.

The front end 7*a* of the core wire press contact piece 7 is preferably located substantially on the same virtual vertical plane as that of the bent part 18 of the front end of the covering member 14. The front ends 7*a* of the core wire press contact pieces 7 are located at both sides of the bent part 18. Under this state, when the pair of core wire press contact pieces 7 are press contacted to the folded portion 17 by an anvil and a crimper of the terminal press contact machine not shown in the drawing, openings at both sides of a front end side of a gap 20 between the folded portion 17 of an upper side and a bottom plate part 19 of a lower side are completely closed without a gap by the core wire press contact pieces 7 at both the sides. Thus, water is prevented from entering inside the folded portion 17 from an external part.

The pair of sheath press contact pieces 6 are attached under pressure and fixed to the sheath 12 of the electric wire 11 by a second anvil and a crimper in both sides of a rear end part 19*b* of the bottom plate part 19 of the covering member 14 at the same time as the core wire press contact pieces 7. The rear end part 19*b* of the bottom plate part 19 is pressed and fixed at both the sides by the pair of sheath press contact pieces 6.

The bottom plate part 19 of the lower side comes into contact with an upper surface of the horizontal base plate 5 of the terminal 1. The first connecting piece 4 continuous to the rear end of the base plate 5 and the second connecting piece 8 continuous to the rear end 19*b* of the bottom plate part 19 are simultaneously cut by the cutting edge (not shown in the drawing) of the terminal press contact machine, for instance, at the same time as the press contact of the electric wire 11 by the terminal press contact machine, so that the terminal 1 is separated from the chain belt 3.

Figure 7:
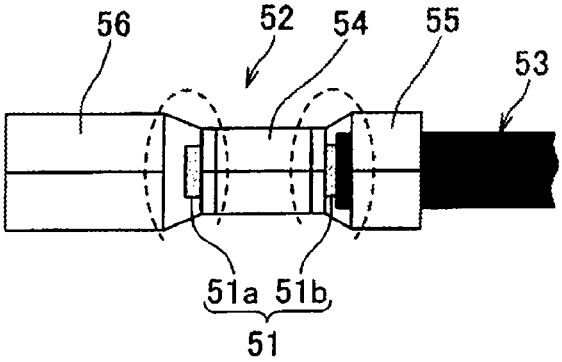
FIG. 7 is a plan view showing one form of a usual press contact terminal.
Figure 8:
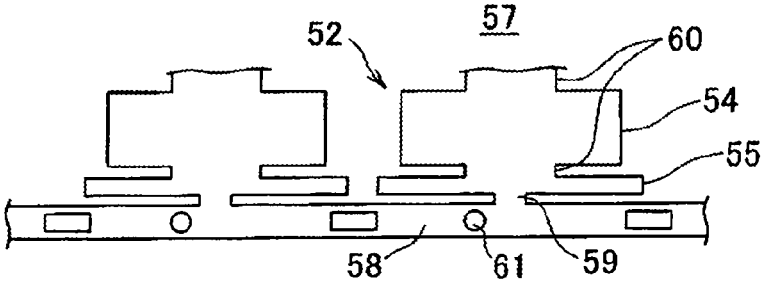
FIG. 8 is a plan view showing an expanded state of a chain terminal in the usual press contact terminal.

In the electric wire covering member 15 of an example shown in FIG. 3, the folded covering plate 9 shown in the right side of FIG. 1 is folded long and rearward in the shape of U substantially from a central position in the longitudinal direction so as to cover an entire part of the core wire 13 of the electric wire 11 shown in FIG. 5 with the long plate shaped folded portion 21. The folded portion 21 shown in FIG. 3 is longer than the folded portion 17 shown in FIG. 2. For instance, in the illustration of the right side shown in FIG. 1, the front end 9*a* of the covering plate 9 is extended to a front part of the core wire press contact piece 7 along the upper surface of the base plate 5. FIG. 5 shows the press contact terminal 1 having the folded portion 21 shown in FIG. 3. When the entire part of the core wire 13 is covered, the core wire exposed parts 51*a* and 51*b* at both the front and rear sides of the core wire press contact part in the usual example shown in FIG. 7 are covered at the same time.

Under a state that the entire part of the core wire 13 of the electric wire 11 is inserted and set into the folded portion 21 shown in FIG. 3 from a rear part, as shown in FIG. 5, the pair of core wire press contact pieces 7 are press contacted inward from both sides of the folded portion 21.

The front end 7*a* of the core wire press contact piece 7 is located substantially on the same virtual vertical plane as that of a bent part 18 of a front end of the covering member 15. The front ends 7*a* of the core wire press contact pieces 7 are located at both sides of the bent part 18. Under this state, since the pair of core wire press contact pieces 7 are attached under pressure onto the folded portion 21 by an anvil and a crimper of the terminal press contact machine, openings at both sides of a gap 20 between the folded portion 21 of an upper side of the covering member 15 and a bottom plate part 19 of a lower side are completely closed from a front end 18*a* to a part subsequent to an intermediate part without a gap by the core wire press contact pieces 7 at both the sides. Thus, water is prevented from entering inside the folded portion 21 from an external part.

Further, as shown in FIG. 5, an end part (a rear end part) 21*a* of the folded portion 21 is extended to an upper surface of the rear sheath 12 from a rear end 13*b* of the core wire 13 of the electric wire 11 to cover a part of the sheath 12. Thus, an upper surface side of the core wire 13*b* between the core wire press contact pieces 7 and the sheath press contact pieces 6 is prevented from being exposed to improve a corrosion resistance.

Since the sheath press contact pieces 6 are press contacted to the end part (the rear end part) 21*a* of the folded portion 21 so that the end part 21*a* of the folded portion 21 is pressed together with the sheath 12 of the electric wire 11 by the sheath press contact pieces 6, a sticking force of the covering member 15 to a terminal main body 22 and a sticking force of the electric wire 11 are improved. Also, a later slip prevention of the electric wire 11 from the terminal 1 is improved. The terminal main body 22 indicates a terminal part excluding the covering member 15.

The pair of sheath press contact pieces 6 are attached under pressure and fixed to the sheath 12 of the electric wire 11 by a second anvil and a crimper at the same time as the core wire press contact pieces 7. The bottom plate part 19 of the lower side of the covering member 15 comes into contact with an upper surface of the horizontal base plate 5 of the terminal 1. The first connecting piece 4 continuous to the rear end of the base plate 5 and the second connecting piece 8 continuous to a rear end of the bottom plate part 19 are simultaneously cut by a cutting edge (not shown in the drawing) of the terminal press contact machine, for instance, at the same time as the press contact of the electric wire 11 by the terminal press contact machine, so that the terminal 1 is separated from the chain belt 3.

In the electric wire covering member 16 of an example shown in FIG. 4, the folded covering plate 9 shown in the right side of FIG. 1 is bent in a cylindrical form in the direction of width on a central line of the covering plate 9 as a center to have a tubular portion 23. An opening 24*a* of an end (a front end) of the tubular portion 23 is sealed which is continuous to a core wire accommodating space 24 having a circular form in section in an inner side of the tubular portion 23. A seal part is designated by reference numeral 25. From an opening 24*b* of a rear end of the tubular portion 23, an entire part of the core wire 13 of the electric wire 11 shown in FIG. 5 is inserted to cover the core wire with the tubular portion 23.

FIG. 5 does not show the example of FIG. 4, however, for convenience sake, the example of FIG. 4 will be described by substituting FIG. 5 for FIG. 4. Since the entire part of the core wire 13 is covered with the tubular portion 23 with a bottom having the sealed part 25, the core wire exposed parts 51*a* and 51*b* at both the front and rear sides of the core wire press contact part in the conventional example shown in FIG. 7 are covered.

Under a state that the entire part of the core wire 13 of the electric wire 11 is inserted and set into the tubular portion 23 shown in FIG. 4 from the rear part, the pair of core wire press contact pieces 7 are press contacted inward from both sides of the tubular portion 23. The front end 7*a* of the core wire press contact piece 7 is located substantially on the same virtual vertical plane as that of the seal part 25 of the front end of the tubular portion 23. The front ends 7*a* of the core wire press contact pieces 7 are located at both sides of the seal part 25. Under this state, since the pair of core wire press contact pieces 7 are attached under pressure onto the tubular portion 23 by an anvil and a crimper of the terminal press contact machine. Since the tubular portion 23 is completely sealed by the seal part 25, water is assuredly prevented from entering inside the tubular portion 23 from an external part.

Further, a rear end part 23*b* of the tubular portion 23 is extended from the rear end 13*b* of the core wire 13 of the electric wire 11 to the rear sheath 12 to cover a part of the sheath 12. Namely, a front end part 12*a* of the sheath 12 is inserted into the rear end part 23*b* of the tubular portion 23.

Thus, the core wire 13 between the core wire press contact pieces 7 and the sheath press contact pieces 6 is completely prevented from being exposed to improve a corrosion resistance. Further, since the sheath press contact pieces 6 are caulked onto the rear end part 23*b* of the tubular portion 23 so that the rear end part 23*b* of the tubular portion 23 is pressed together with the sheath 12 of the electric wire 11 by the sheath press contact pieces 6, a sticking force of the tubular portion 23 to a terminal main body 22 and a sticking force of the electric wire 11 are improved. Also, a later slip prevention of the electric wire 11 from the terminal 1 is improved. The terminal main body 22 indicates a terminal part excluding the covering member 16.

As the seal part 25, for instance, a substantially circular seal part which is not shown in the drawing is integrally formed and connected to a center in the direction of width of the front end of the covering plate 9 shown in the right side of FIG. 1. Both side parts 9*c* of the covering plate 9 are bent upward in FIG. 1 to form the tubular portion 23 shown in FIG. 4. At the same time, the seal part 25 is raised to close the front opening 24*a* of the tubular portion 23. Otherwise, after the tubular portion 23 shown in FIG. 4 is formed, a front end part of the tubular portion 23 is squeezed by a press work to have the seal part 25. Further, the seal part 25 may be suitably formed by various methods.

A lower end of the tubular portion 23 comes into contact with an upper surface of the horizontal base plate 5 of the terminal 1. The first connecting piece 4 continuous to the rear end of the base plate 5 and the second connecting piece 8 continuous to a lower part of the rear end of the tubular portion 23 are simultaneously cut by a cutting edge (not shown in the drawing) of the terminal press contact machine, for instance, at the same time as the press contact of the electric wire 11 by the terminal press contact machine, so that the terminal 1 is separated from the chain belt 3.

When the transverse chain terminal 2 shown in FIG. 1 is formed with a copper alloy as a material and the core wire 13 of the electric wire 11 shown in FIG. 5 is formed with aluminum as a material, corrosion caused by the mutual contact of dissimilar metals with water can be assuredly prevented by the structures of the covering members 14 to 16 shown in FIGS. 2 to 4. It is to be understood that the terminal 1 and the core wire 13 may be effectively formed with the same kind of metal material.

Figure 6A:
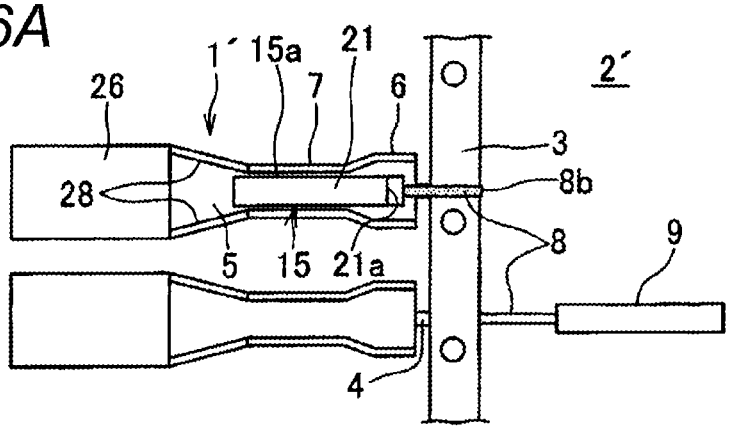
FIG. 6A is a plan view of one modified example of the water proof press contact terminal.
Figure 6B:
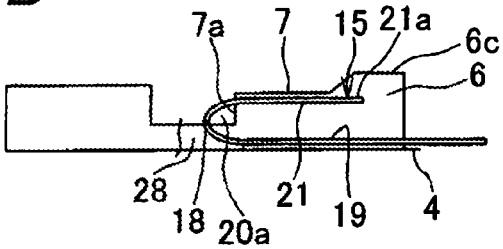
FIG. 6B is a partly sectional side view of the modified example of the water proof press contact terminal shown in FIG. 6A.

FIGS. 6A and 6B show one modified example of the water proof press contact terminal 1 of the exemplary embodiment shown in FIGS. 1, 3 and 5. As different points, below-described structures are exemplified, for instance, core wire press contact pieces 7 and sheath press contact pieces 6 of a press contact terminal 1' are integrally formed and raised on a base plate 5, a width of an electric wire covering plate 9 is smaller than that of the base plate 5 of the terminal 1' and a bent part 18 of an electric wire covering member 15 is arranged slightly forward a front end 7*a* of the core wire press contact piece 7 as shown in FIG. 6B. Since other structures are substantially the same, for convenience sake, the same reference numerals as those of FIGS. 1, 3 and 5 are used to describe the structures.

As shown in FIG. 6A, a rear half part of the covering plate 9 continuous to a rear part through a second connecting piece 8 from a chain belt 3 of a transverse chain terminal 2' is folded downward to form a folded portion 21. The electric wire covering member 15 including the folded portion 21 and a bottom plate part 19 is folded forward from a base end 8*b* of the second connecting piece 8 and accommodated and arranged between pairs of press contact pieces 6 and 7 respectively. A rear end 21*a* of the folded portion 21 is located between one pair of sheath press contact pieces 6.

Otherwise, the covering plate 9 protruding rearward from the chain belt 3 so as to be longer than in FIG. 6 may be folded forward from the base end 8*b* of the second connecting piece 8, and then, a front half part of the covering plate 9 may be folded rearward to form the folded portion 21 as shown in FIG. 6B.

As shown in FIG. 6A, small gaps are formed between side ends 15*a* of the covering member 15 and inner surfaces of the pair of core wire press contact pieces 7, so that an inward press contact of the core wire press contact pieces 7 is smoothly carried out. A space between the pair of sheath press contact pieces 6 is larger than a space between the pair of core wire press contact pieces 7. Thus, an upper surface of the rear end part 21*a* of the folded portion 21 is smoothly and assuredly caulked and fixed by upper ends 6*c* of the sheath press contact pieces 6. The upper ends 6*c* become lower ends after a press contact.

As shown in FIG. 6B, the pair of core wire press contact pieces 7 are continuous to a pair of front low side walls 28. The side walls 28 are respectively continuous to both side parts of a female type electric contact part 26. When the core wire 13 of the electric wire is inserted into the covering member 15 from a rear part and the press contact pieces 6 and 7 are respectively pressed, and the folded portion 21 is lowered from a state shown in FIG. 6B, so that the bent part 18 is squeezed in the vertical direction and accommodated between the pair of side walls 28 to seal a gap 20*a* inside the bent part 18 by the side walls 28. In the example shown in FIG. 5, the gap 20 is sealed by the pair of core wire press contact pieces 7. Thus, a water proof property of a front end side of the covering member 15 is improved. A water proof property of a rear end side of the covering member 15 is improved by pressing downward and closing the rear end part 21*a* of the folded portion 21 by the pair of sheath press contact pieces or compressing pieces 6.

In the above-described exemplary embodiment, the electric wire covering member 16 shown in FIG. 4 is described as a member into which both the core wire 13 of the electric wire 11 and the sheath 12 are inserted to be covered. However, the covering member 16 shown in FIG. 4 may be shortened to insert and cover only the core wire 13 of the electric wire 11 shown in FIG. 5. For instance, the covering member 16 may cover from the front end 13*a* to the rear end 13*b* of the core wire 13. In this case, the second connecting piece 8 shown in the right side of FIG. 1 is extended forward and the covering plate 9 is separated forward from the sheath press contact pieces 6 and the press contact by the sheath press contact pieces 6 is not carried out.

In FIG. 5, the core wire 13 and the sheath 12 are shown so as to have substantially the same outside diameter. However, actually, the sheath 12 has the diameter larger than that of the core wire 13 so that there is a stepped part between both the parts. Accordingly, for instance, the sheath 12 may be forcibly pressed by the rear end part 21*a* of the straight folded portion 21 of the example shown in FIG. 3, the core wire 13 may be inserted so as to be freely fitted to the straight tubular portion 23 of the example shown in FIG. 4 or the folded portion 21 shown in FIG. 3 or the tubular portion 23 shown in FIG. 4 may be bent in the form of a stepped part along the stepped part between both the parts 12 and 13.

Further, in the above-described exemplary embodiment, as shown in the right side of FIG. 1, the covering plate 9 is folded together with the second connecting piece 8, and then, the covering plate 9 is bent to have the covering members 14 to 16 respectively described in the examples. However, as shown in an illustration of a left side or a central part in FIG. 1, under a state that the covering plate 9 is arranged in a rear part of the chain belt 3, the covering plate 9 may be bent to have the covering members 14 to 16, and then, the covering members 14 to 16 may be folded forward together with the connecting piece 8. The latter is rather better in bending workability than the former.

In the above-described exemplary embodiment, the press contact terminal 1 is shown that has the female type electric contact part 26. However, a press contact terminal having a male type (a tab type or a pin type) electric contact part may be used in place of the press contact terminal having the female type electric contact part. Further, the present invention is effectively applied to a press contact terminal with an electric wire or a connecting structure of a press contact terminal and an electric wire as well as the water proof press contact terminal 1.

According to the invention, since at least the end part of the core wire of the electric wire is partly or totally covered and waterproofed with the folded portion of the upper side of the electric wire covering member and the pair of first press contact pieces, the corrosion of the end part of the core wire can be prevented and a reliability of aging electric connection between the electric wire and the terminal can be improved.

According to the invention, since at least the end part of the core wire of the electric wire is completely covered and waterproofed with the folded portion of the upper side of the electric wire covering member and the pair of first press contact pieces or the pair of side walls, the corrosion of the end part of the core wire can be more prevented and a reliability of aging electric connection between the electric wire and the terminal can be more improved.

According to the invention, since the core wire to the sheath of the electric wire is covered with the folded portion, the water proof property of the core wire between the core wire press contact pieces and the second press contact pieces can be improved and the reliability in aging electric connection can be more improved.

According to the invention, since the core wire of the electric wire is inserted into the tubular portion from the end side and covered and waterproofed with the tubular portion, the corrosion of at least the end part of the core wire can be prevented and the reliability in aging electric connection between the electric wire and the terminal can be improved.

According to the invention, since the core wire to the sheath of the electric wire is covered with the tubular portion in the circumferential direction, the water proof property of the core wire between the first press contact pieces and the second press contact pieces can be improved and the reliability in aging electric connection can be more improved.

According to the invention, the covering member is strongly pressed by the second press contact pieces, so that an adhesion between the covering member and the sheath of the electric wire can be improved to improve the water proof property.

According to the invention, since the second connecting piece and the covering plate are integrally formed in an opposite side to the first connecting piece of the chain belt of the existing chain terminal, the waterproofing electric wire covering member can be simply and inexpensively provided without widening pitches respective between the terminals.

The present application is based on Japanese Patent Application No. 2010-231393 filed on Oct. 14, 2010, the contents of which are incorporated herein by way of reference.

The water proof press contact terminal and the method for forming the water proof press contact terminal according to the present invention can be used for preventing water from sticking to a contact part of a core wire and the terminal to cause corrosion, for instance, when the terminal and the core wire of an electric wire are formed with dissimilar metals.

What is claimed is:

1. A water proof press contact terminal, comprising:

a base portion;

a pair of first press contact pieces, provided at both sides of a front part of the base portion;

a pair of second press contact pieces, provided at both sides of a rear part of the base portion, and configured to press contact a sheath of a wire; and a covering member provided on the base portion, and including a bottom part extending along the base portion and a folded part folded from a front end of the bottom part and extending rearward, wherein a core wire of the wire is inserted into a gap between the bottom part and the folded part, and is press contacted by the first press contact pieces together with the folded part.

2. The water proof press contact terminal as set forth in claim 1, wherein at least a front end part of the gap is covered with the pair of the first press contact pieces or a pair of side walls extended forward from the first press contact pieces respectively, in a state where the core wire is press contacted thereby.

3. The water proof press contact terminal as set forth in claim 1, wherein the folded portion extends from the front end of the bottom part to the sheath so as to cover a part of the sheath.

4. The water proof press contact terminal as set forth in claim 2, wherein the folded portion is press contacted by the second press contact pieces.

5. A method for forming the water proof press contact terminal as set forth in claim 1, the method comprising:

preparing a chain terminal, being expanded, and including:

a chain belt;

a first connecting portion extended from one side of the chain belt;

the base portion connected to the first connecting portion;

the first press contact pieces and the second press contact pieces;

a second connecting portion extended from the other side of the chain belt; and a covering plate connected to the second connecting portion, folding the covering plate together with the second connecting portion so that the covering plate is disposed on the base portion; and bending the covering plate to form the covering member, after the folding of the covering plate, wherein at least a front end part of a gap of the covering plate is covered with the pair of the first press contact pieces in a state where a core wire is press contacted thereby.

6. A water proof press contact terminal, comprising:

a base portion;

a pair of first press contact pieces, provided at both sides of a front part of the base portion;

a pair of second press contact pieces, provided at both sides of a rear part of the base portion, and configured to press contact a sheath of a wire; and a covering member provided on the base portion, wherein a core wire of the wire is inserted into the covering member so as to be covered in a waterproof manner, and is press contacted by the first press contact pieces together with the covering member, the covering member includes a tubular portion extending along the base portion and a seal portion sealing a front opening of the tubular portion, and the core wire is inserted into inside of the tubular portion, and the tubular portion is press contacted by the first press contact pieces together with the core wire.

7. The water proof press contact terminal as set forth in claim 6, wherein the core wire and a part of the sheath of the wire are inserted into the tubular portion.

8. The water proof press contact terminal as set forth in claim 7, wherein the tubular portion is press contacted by the second press contact pieces.

* * * * *